US007127199B2

(12) United States Patent
Imamura et al.

(10) Patent No.: US 7,127,199 B2
(45) Date of Patent: Oct. 24, 2006

(54) DEVELOPING DEVICE AND PROCESS CARTRIDGE WITH PREDETERMINED MAGNETIC FORCE FOR AN IMAGE FORMING APPARATUS

(75) Inventors: Tsuyoshi Imamura, Kanagawa (JP); Sumio Kamio, Tokyo (JP); Kyohta Koetsuka, Kanagawa (JP); Noriyuki Kamiya, Kanagawa (JP); Mieko Kakegawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/440,108

(22) Filed: May 19, 2003

(65) Prior Publication Data

US 2004/0018031 A1 Jan. 29, 2004

(30) Foreign Application Priority Data

May 20, 2002 (JP) ..... 2002-144557
Apr. 15, 2003 (JP) ..... 2003-110370

(51) Int. Cl.
*G03G 15/08* (2006.01)
*G03G 15/09* (2006.01)

(52) U.S. Cl. ..... 399/277

(58) Field of Classification Search ..... 399/277
See application file for complete search history.

(56) References Cited

U.S. PATENT DOCUMENTS 4,614,420 A * 9/1986 Lubinsky et al. ..... 399/277
4,793,691 A 12/1988 Enomoto et al.
4,984,873 A 1/1991 Takiguchi et al.
5,044,733 A 9/1991 Kamoi et al.
5,244,741 A 9/1993 Nagano et al.
5,513,026 A 4/1996 Suzuki et al.
5,566,013 A 10/1996 Suzuki et al.
5,970,294 A 10/1999 Narita et al.
6,070,038 A 5/2000 Imamura et al.
6,112,042 A 8/2000 Imamura et al.
6,198,895 B1 3/2001 Tsuda et al.
6,262,787 B1 7/2001 Kamoi et al.
6,287,246 B1 9/2001 Yoshii et al.
6,330,415 B1 12/2001 Imamura et al.
6,337,957 B1 1/2002 Tamaki et al.
6,379,759 B1 4/2002 Kamoi et al.
6,522,855 B1 2/2003 Katoh et al.
6,792,234 B1 * 9/2004 Ikeguchi et al. ..... 399/267
2004/0018031 A1 1/2004 Imamura et al.

FOREIGN PATENT DOCUMENTS

JP 08015988 A * 1/1996

OTHER PUBLICATIONS

U.S. Appl. No. 11/353,119, filed Feb. 14, 2006, Imamura.

* cited by examiner

*Primary Examiner*—Quana Grainger
(74) *Attorney, Agent, or Firm*—Oblon, Spivak, McClelland, Maier & Neustadt, P.C.

(57) ABSTRACT

A developing device for developing a latent image formed on an image carrier of the present invention includes a rotatable, nonmagnetic developer carrier, and a magnetic field generating member for generating a magnetic field in a developing zone where the developer carrier faces the image carrier. The magnetic field generated causes a developer deposited on the developer carrier to rise in the form of a magnet brush. A magnetic pole for development is located upstream of a position where the developer carrier and image carrier are closest to each other in a direction of rotation. A magnetic force, as measured on the surface of the developer carrier, increases from the position of the magnetic pole toward a position where the magnet brush finally leaves the image carrier.

60 Claims, 17 Drawing Sheets

FIG. 13

| DRUM DIAMETER | ROLLER DIAMETER | HALF-WAVE WIDTH | IN POLE WIDTH | IMAGE QUALITY |
|---|---|---|---|---|
| 30 | 16 | 40 | 5.6 | △ |
| | | 30 | 4.2 | ○ |
| | | 20 | 2.8 | ◎ |
| | 18 | 40 | 6.3 | △ |
| | | 30 | 4.7 | △ |
| | | 25 | 3.9 | ○ |
| | | 20 | 3.1 | ○ |
| 60 | 20 | 30 | 5.2 | △ |
| | | 25 | 4.4 | △ |
| | | 20 | 3.5 | ○ |
| | 18 | 40 | 6.3 | △ |
| | | 30 | 4.7 | △ |
| | | 25 | 3.9 | △ |
| | | 20 | 3.1 | ○ |
| | 16 | 40 | 5.6 | △ |
| | | 30 | 4.2 | △ |
| | | 20 | 2.8 | ○ |

※ POLE WIDTH = CIRCUMFERENCE (= OUTSIDE DIAMETER × π) × HALF-VALUE / 360°

FIG. 14

| CARRIER GRAIN SIZE | IMAGE QUALITY | CARRIER DEPOSITION |
|---|---|---|
| 55 μm | X ~ Δ | ◎ |
| 35 μm | ○ | ○ |

◎ EXCELLENT ○ GOOD Δ ALLOWABLE LIMIT X VARY POOR (UNALLOWABLE)

FIG. 15

| CARRIER GRAIN SIZE | IMAGE QUALITY | CARRIER DEPOSITION |
|---|---|---|
| 55 μm | ×~△ | ◎ |
| 35 μm | ○ | ◎ |

◎ EXCELLENT ○ GOOD △ ALLOWABLE LIMIT × VERY POOR (UNALLOWABLE)

FIG. 16

| CARRIER GRAIN SIZE | IMAGE QUALITY | CARRIER DEPOSITION |
|---|---|---|
| 5 5 μm | ×~△ | ○ |
| 3 5 μm | ○ | ×~△ |

◎ EXCELLENT ○ GOOD △ ALLOWABLE LIMIT × VERY POOR (UNALLOWABLE)

DEVELOPING DEVICE AND PROCESS CARTRIDGE WITH PREDETERMINED MAGNETIC FORCE FOR AN IMAGE FORMING APPARATUS

BACKGROUND OF THE INVENTION

1. Field of the Invention

The present invention relates to a copier, facsimile apparatus, printer, direct digital plate-making machine or similar electrophotographic image forming apparatus and more particularly to a developing device using a magnetic force and a process cartridge including the same.

2. Description of the Background Art

Generally, in an electrophotographic image forming apparatus, a latent image is formed on an image carrier in accordance with image data and then developed by a developing device to become a toner image. It is a common practice with this type of image forming apparatus to use a two-ingredient type developer made up of nonmagnetic toner grains and magnetic carrier grains.

In a developing system using a two-ingredient type developer, the shorter the distance between the image carrier and the developer carrier in a developing zone, the more adequate the image density and the less the edge effect, as known in the art. Also, to enhance the developing ability and therefore image density, the amount of developer to be fed may be increased to increase the amount of developer in the developing zone. However, these schemes both bring about carrier deposition. Carrier deposition refers to a phenomenon that an electric force derived from an electric field between the carrier grains and the image carrier overcomes a magnetic force exerted on the carrier grains by the developer carrier and prevents the magnetic force from returning the carrier grains around the image carrier toward the developer carrier.

To obviate carrier deposition, the charge potential of the image carrier and the potential of the developer carrier may be so controlled as to reduce the electric force exerted by the image carrier. This, however, gives rise to another problem that the toner grains are apt to deposit on the non-image portion or background of the image carrier and contaminate it.

Today, the grain size of carrier and that of toner are decreasing in order to meet the increasing demand for higher image quality. Although reducing the grain sizes of carrier and toner enhances image quality, as reported in the past, this scheme aggravates carrier deposition. This is particularly true when the grain size of carrier is reduced.

SUMMARY OF THE INVENTION

It is an object of the present invention to provide a developing device capable of realizing high image quality while reducing carrier deposition without lowering the electric force of an image carrier, and a process cartridge including the same.

A developing device for developing a latent image formed on an image carrier of the present invention includes a rotatable, nonmagnetic developer carrier, and a magnetic field generating member for generating a magnetic field in a developing zone where the developer carrier faces the image carrier. The magnetic field generated causes a developer deposited on the developer carrier to rise in the form of a magnet brush. A magnetic pole for development is located upstream of a position where the developer carrier and image carrier are closest to each other in a direction of rotation. A magnetic force, as measured on the surface of the developer carrier, increases from the position of the magnetic pole toward a position where the magnet brush finally leaves the image carrier.

A process cartridge including the above developing device is also disclosed.

BRIEF DESCRIPTION OF THE DRAWINGS

The above and other objects, features and advantages of the present invention will become more apparent from the following detailed description taken with the accompanying drawings in which:

FIG. 13 is a table listing the results of estimation of image quality with respect to various diameters of the developing roller and those of the photoconductive drum;

FIG. 14 is a table listing a relation between image carrier and carrier deposition with respect to the mean grain size of carrier grains, as determined in Example 1;

FIG. 15 is a table listing a relation between image carrier and carrier deposition with respect to the mean grain size of carrier grains, as determined in Example 2; and FIG. 16 is a table listing a relation between image carrier and carrier deposition with respect to the mean grain size of carrier grains, as determined in Comparative Example.

DESCRIPTION OF THE PREFERRED EMBODIMENT

Figure 1:
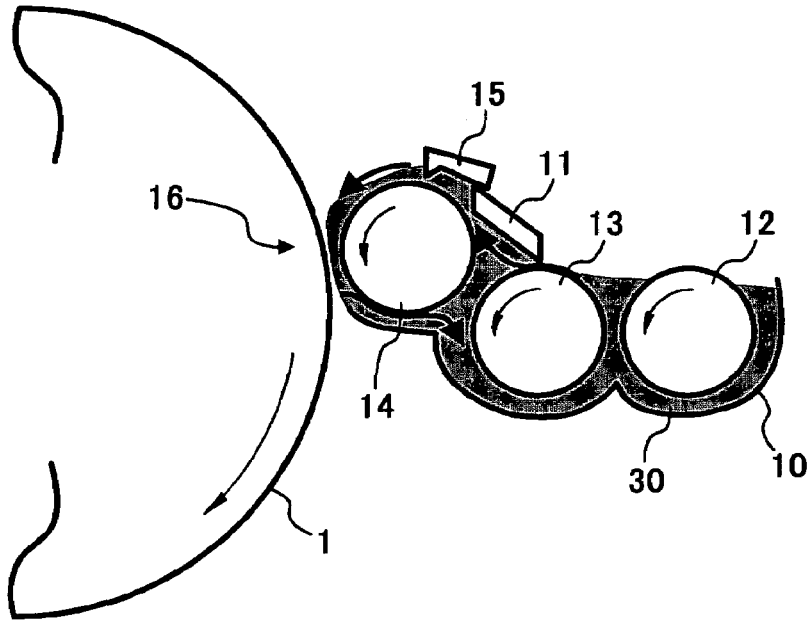
FIG. 1 PRIOR ART
FIG. 1 is a view showing a relation between a photoconductive drum and a conventional developing device using a two-ingredient type developer.

FIG. 1 shows a positional relation between a conventional developing device using a two-ingredient type developer and a photoconductive drum or image carrier. As shown, the developing device includes a developer case 10 storing a developer 30 made up of toner and carrier. Paddles or agitating rollers 12 and 13 convey the developer 30 toward a developing roller or developer carrier 14 while agitating it. As a result, the developer deposits on the developing roller 14 in the form of brush chains while being metered by a doctor blade 15. In a developing zone 16 where the developing roller 14 faces the drum 1, the toner contained in the developer is transferred from the developing roller 14 to a latent image formed on the drum 1. The developing roller 14 adjoins the drum 1, as illustrated. In FIG. 1, the reference numeral 11 designates a slide plate.

The problem with the developing device of the type described is that when the distance between the drum 1 and the developing roller 14 is reduced to enhance the developing ability, carrier deposition occurs, as stated earlier.

After a series of researches and experiments, we found that a force with which a developing roller or similar developer carrier attracts a carrier was determined by the vector sum of a radial and a tangential magnetic force. More specifically, when a magnetic force to act on a developer was made stronger at a position, within a developing zone, where a magnet brush or developer finally left an image carrier than at a position where a magnetic pole for development was present, carrier deposition was obviated with high image quality being preserved. The developing zone refers to a range over which a developer on a developer carrier rises in the form of brush chains and can release toner toward an image carrier in contact with the image carrier.

A radial magnetic force Fr and a tangential magnetic force Fθ are expressed as:

$$Fr=GS\times(Hr\times(dHr/dr)+H\theta\times(dH\theta/dr))$$

$$F\theta=GS/r\times(Hr\times(dHr/d\theta)+H\theta\times(dH\theta/d\theta))$$

where Hr and Hθ respectively denote flux densities in the radial and tangential directions, r denotes a distance between the center of a developer carrier and a point of measurement, and GS denotes a constant determined by the characteristics of a carrier. The constant GS is $\mu 0\times G\times(\mu S-1)$ where μ0 denotes the permeability of vacuum, G denotes the volume of a carrier, and μS denotes the specific permeability of a carrier.

Carrier deposition occurs when the developer carrier cannot sufficiently attract the carrier at the position where the magnet brush leaves the image carrier, as stated above. In light of this, the magnetic pole for development may be tilted toward a position downstream of the position where the developer carrier and image carrier are closest to each other (closest position hereinafter, thereby increasing the magnetic force at the downstream side. This, however, prevents the developer from sufficiently rising in the form of brush chains around the closest position and thereby obstructs the flight of toner grains from carrier grains present on or around the surface of the developer carrier, lowering developing efficiency.

Figure 2:
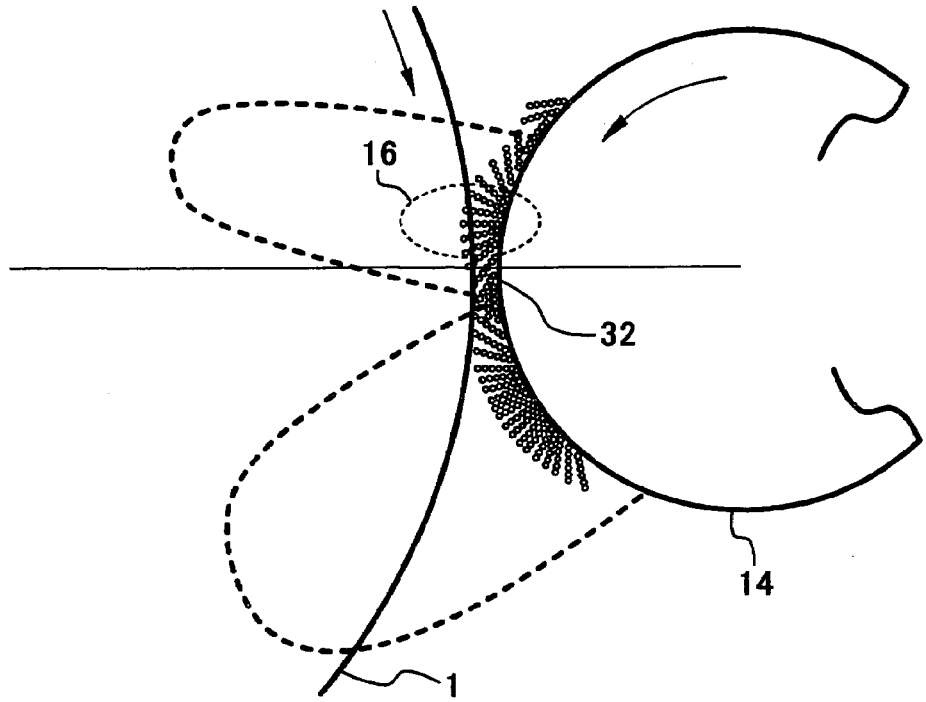
FIG. 2 PRIOR ART
FIG. 2 demonstrates how the developer rises in the form of a magnet brush.

As shown in FIG. 2, the magnet brush rises and falls on the developing roller or developer carrier 14. If the width between the rise and fall of the magnet brush can be reduced, then the distance between the drum 1 and the developing roller 14 in the developing zone 16, i.e., a nip for development can be reduced in order to achieve desirable image density. The above width is dependent on the attenuation ratio of the radial flux density, i.e., the former decreases with an increase in the latter.

The attenuation ratio mentioned above is a value produced by dividing a difference between the peak value of a radial flux density on the surface of the developing roller 14 and the peak value of the same at a position 1 mm spaced from the above surface by the former peak value. Experiments showed that to increase the attenuation ratio of the radial flux density, a half-value width relating to a magnetic force distribution curve in the radial direction had to be reduced. The half-value width refers to an angular width between positions where the magnetic force is one-half of the maximum, normal magnetic force (peak) of the curve mentioned above. For example, when the maximum, normal magnetic force of an N-pole magnet is 120 mT, the half value (50%) is 60 mT. In FIG. 2 the reference numeral 32 designates the closest position of the developing roller 14 and drum 1.

Figure 3:
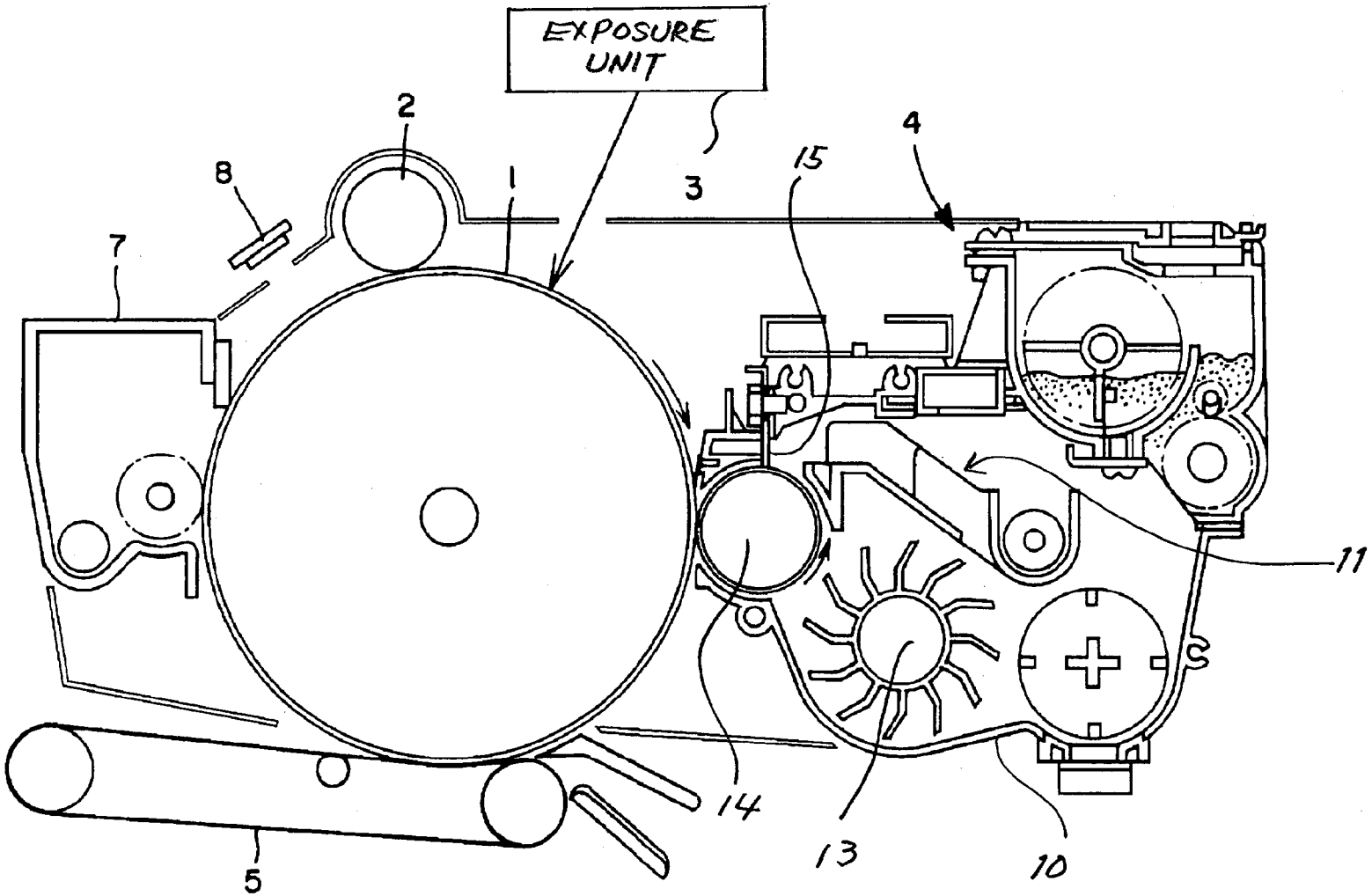
FIG. 3 is a view showing an image forming apparatus to which the present invention is applied.

Referring to FIG. 3 an image forming apparatus to which the present invention is applied is shown and includes a photoconductive drum or image carrier 1. Arranged around the drum 1 are a charger 2, an exposing unit 3, a developing device 4, an image transferring device 5, a drum cleaner 7, and a quenching lamp or discharging device 8. The charger 2 uniformly charges the surface of the drum 1 and may be implemented as a charge roller. The exposing unit 3 forms a latent image on the charged surface of the drum 1 with, e.g., a laser beam. The developing device 4 develops the latent image with charged toner to thereby produce a corresponding toner image. The image transferring device 5 transfers the toner image from the drum 1 to a sheet or recording medium and includes a belt, a roller or a charger by way of example. The drum cleaner 7 removes toner left on the drum 1 after the image transfer. The quenching lamp 8 dissipates potentials left on the drum 1 so cleaned by the drum cleaner 7.

At least the drum 1 and developing device 4 are constructed into a cartridge unit or may additionally be combined with the charger 2, drum cleaner 7 and quenching lamp 8 to constitute a process cartridge. The process cartridge refers to a cartridge including the developing device 4 and other process means and removably mounted to the image forming apparatus. In this sense, even the cartridge unit may be referred to as a process cartridge; the developing device 4, drum 1 and charger 2 or the developing device 4, drum 1, charger 2 and drum cleaner 7 may be combined by way of example.

In operation, the exposing unit 3 forms a latent image on the surface of the drum 1 charged by the charger 2 in accordance with image data to thereby form a latent image. The developing unit 4 develops the latent image for thereby producing a corresponding toner image. The image transferring device 5 transfers the toner image from the drum 1 to a sheet fed from a sheet tray not shown. Subsequently, a fixing unit, not shown, fixes the toner image on the sheet. On the other hand, the drum cleaner 7 collects toner left on the drum 1 after the image transfer, and then the quenching lamp 8 initializes the drum 1 to thereby prepare it for the next image forming cycle.

As for the general construction, the developing device 4 of the present invention shown in FIG. 3 is identical with the conventional developing device of FIG. 1. The following description will therefore concentrate on part of the developing device 4 essential with the present invention.

Figure 4A:
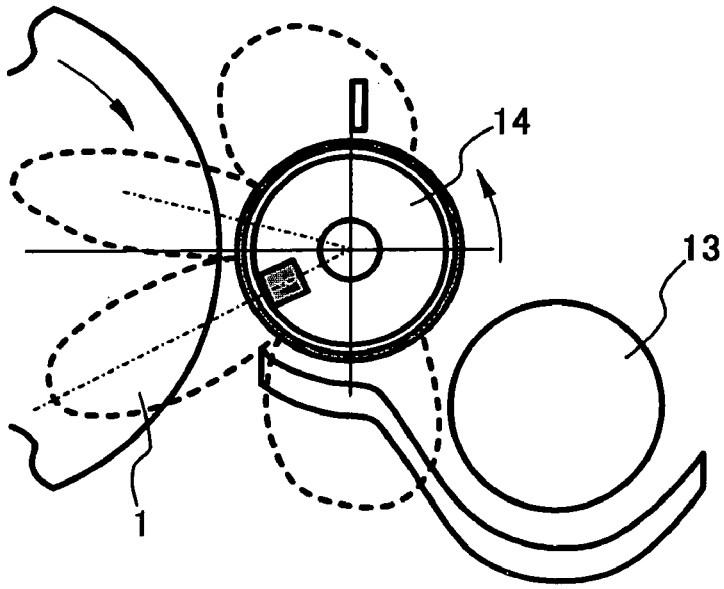
FIG. 4A shows a positional relation between a developing roller and a paddle included in the developing device of FIG. 3 and a photoconductive drum.
Figure 4B:
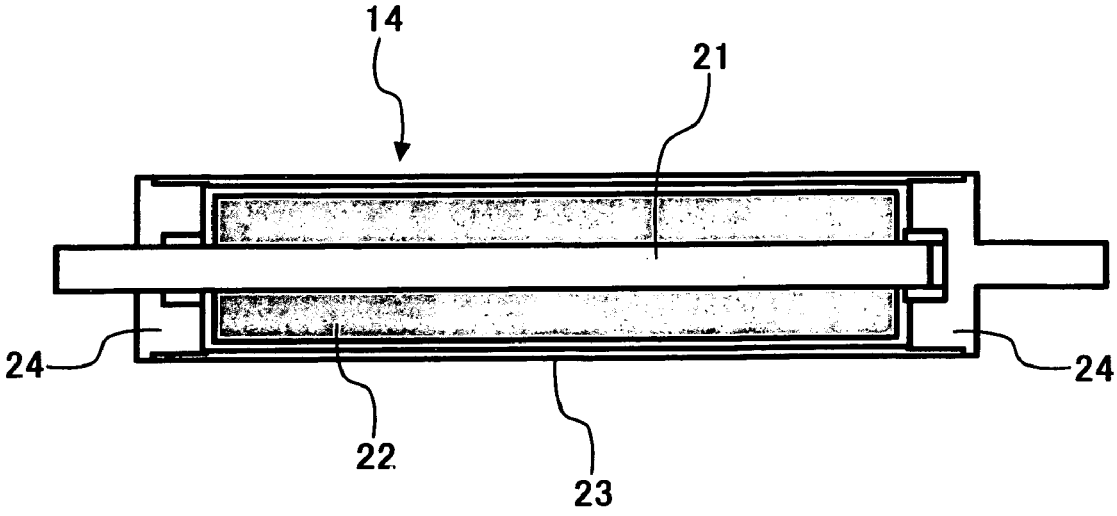
FIG. 4B is a vertical section showing the developing roller of FIG. 4A.
Figure 5:
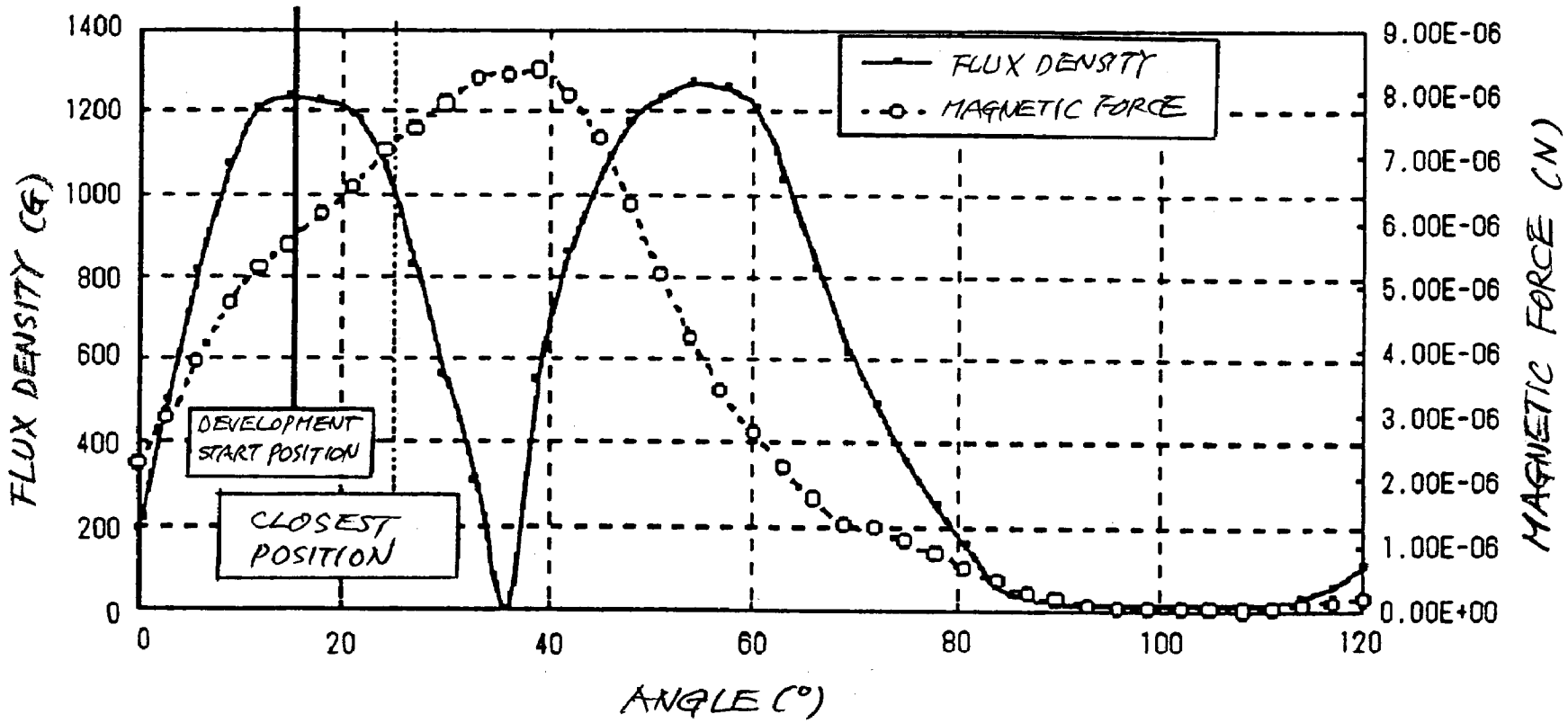
FIG. 5 is a graph showing the magnetic field distribution of the developing roller in X-Y indication.

FIGS. 4A and 4B show a developing roller 14 included in the developing device 4 specifically while FIG. 5 shows a specific magnetic force distribution (XY indication). As shown in FIG. 4B, the developing roller 14 is made up of a magnet portion 22 affixed to the developing device 4 via a shaft 21, a freely rotatable, nonmagnetic sleeve or developer carrier 23, and flanges 24 supporting the sleeve 23.

As for the magnetic poles of the developing roller 14, a pole for development is, in many cases, located at the closest position 32, FIG. 2, or several degrees upstream of the closest position 32. In this case, if the flux density of the above pole is high and makes the magnetic force acting on the developer in the developing zone 16, FIG. 2, excessively strong, then toner once deposited on the drum 1 is again scraped off. It is therefore not desirable to excessively increase the flux density of the pole for development from the image quality standpoint. On the other hand, carrier deposition occurs if the electric force acting on the developer, i.e., attracting it toward the drum 1 is stronger than the magnetic force attracting the developer toward the sleeve 14. In this sense, the flux density and therefore magnetic force should preferably be increased from the carrier deposition standpoint.

In accordance with the present invention, the magnetic force acting on the developer is made stronger at the position where the magnet brush finally leaves the drum 1 than at the position where the pole for development is located. More specifically, as shown in FIG. 5, the magnetic force is not so strong in a region where development starts, i.e., around a development start position, so that an attractive image is achievable. In a region downstream of the above region, i.e., around a closest position shown in FIG. 5 and where the magnet brush is oriented tangentially to the sleeve 14 and then finally leaves the drum 1, the magnetic force is strong enough to obviate carrier deposition. That is, the development start position should preferably be located upstream of the closest position. It is preferable that the magnetic force increases little by little from the position of the pole for development P1 to the position where the magnet brush finally leaves the drum 1. This is because if the magnetic force decreases in the portion between the position of the pole and the position where the magnet brush finally leaves the drum 1, then the carrier is apt to deposit on the drum 1 in the above portion.

Among characteristics required of the developing roller 14, not only the pole for development but also the flux density of a pole downstream of the above pole are important. The position where the magnet brush finally leaves the drum 1 is located between the pole for development and the downstream pole, so that the flux density of the downstream pole must be increased to increase the magnetic force. This, coupled with the fact that a strong magnetic force around the pole for development renders an image defective, indicates that increasing the flux density of the downstream pole is more effective than increasing the flux density of the pole for development.

A high flux density is achievable if use is made of magnets formed of a material having high magnetic characteristics, e.g., Ne—Fe—B or Sm—Fe—N magnets containing rare earth metals. However, such a material is generally expensive and increases the cost of the developing roller 14. In light of this, in accordance with the present invention, a material containing rare earth metal is applied only to the downstream pole whose flux density should be increased, thereby realizing a low cost, high flux density developing roller.

Generally, a developing system using a two-ingredient type developer repeats a cycle in which a developer with a low toner content effected development is released in a developing device, agitated together with the other developer, and again deposited on a developing roller. At this instant, the developer is, in many cases, is released at a position downstream of the downstream pole because of the configuration of a developing device. It was experimentally found that the developer was effectively released if a magnetic field distribution low in flux density, but not inverted in polarity, was established at the above position (downstream of a downstream pole P2, FIG. 6).

Figure 6:
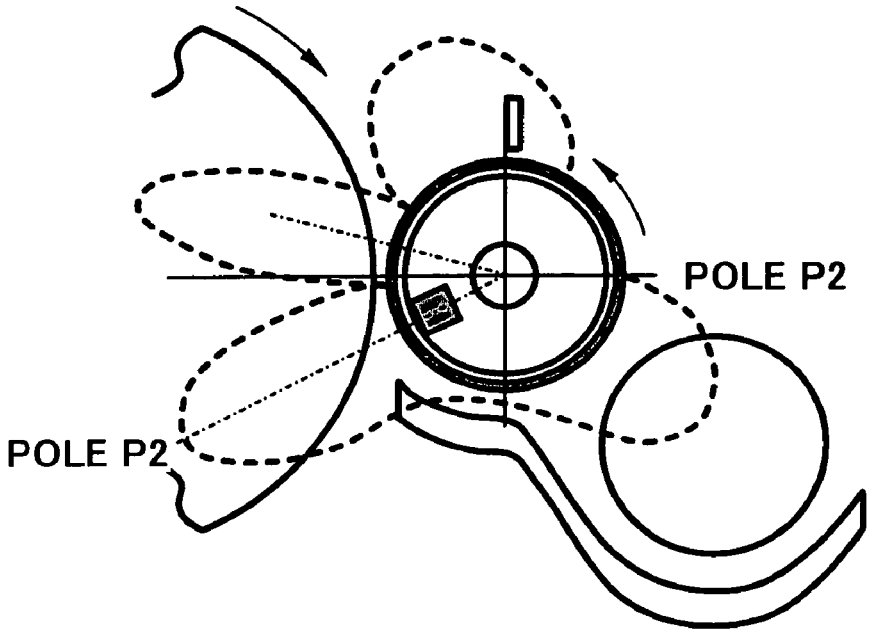
FIG. 6 shows the magnetic characteristics of a developing roller in accordance with the present invention.
Figure 7:
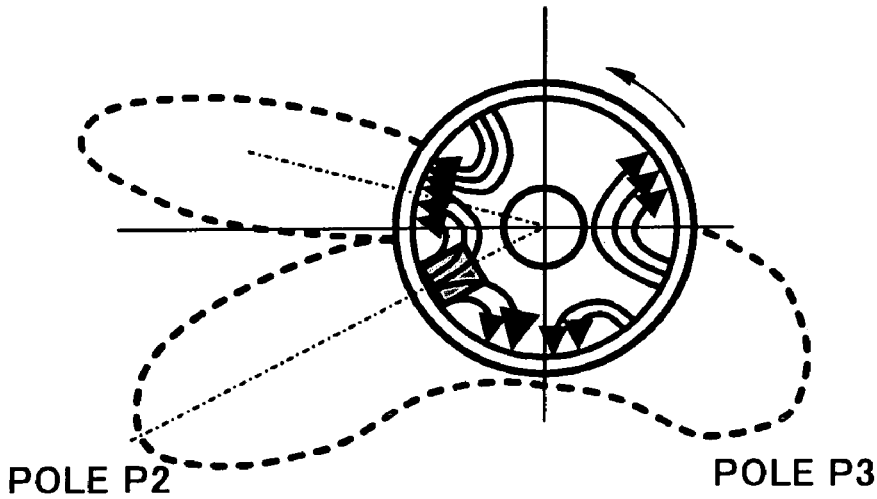
FIG. 7 shows a magnetic field distribution inside the developing roller.

In the magnetic field distribution shown in FIG. 6, a pole P3 downstream of the downstream pole P2 is of the same polarity as the pole P2. It is difficult to attain a high magnetic characteristics with the poles P2 and P3 for the following reason. As shown in FIG. 7, the magnetic field distribution inside the developing roller is such that a magnetic field flows from one pole to another pole adjoining it. However, the portion between the poles P2 and P3 where the developer should be released is extremely weakly magnetized. More specifically, in this particular portion, the magnetic field distribution is concave and not inverted in polarity on the sleeve, but is magnetized to the opposite polarity on the magnet, forming a so-called repulsive magnetic field. This makes it difficult to increase the flux densities of the adjoining poles P2 and P3.

If the densities of the poles P2 and P3 are increased, then the pole at the releasing portion is inverted and obstruct the release of the developer. In this condition, applying a material containing rare earth metal to the pole P2 is extremely effective means for increasing the flux density of the downstream pole.

Figure 8A:
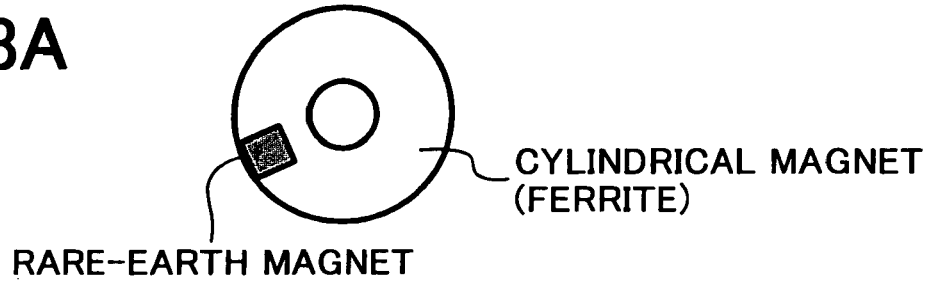
FIGS. 8A through 8C are sections each showing a particular configuration of the developing roller.
Figure 8B:
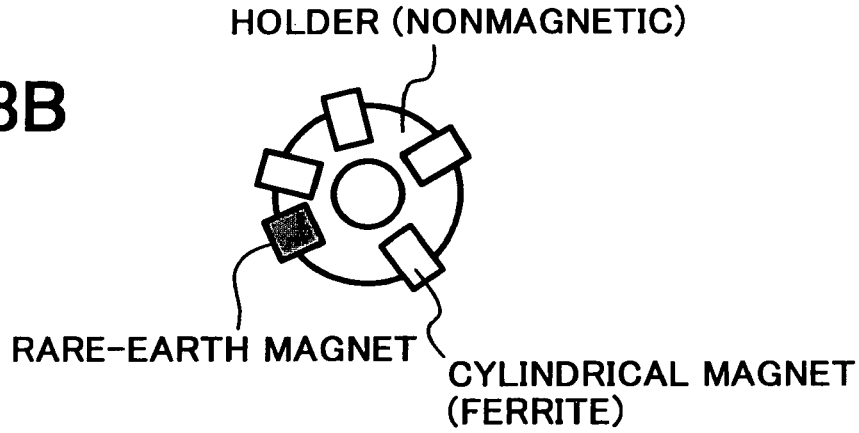
Figure 8C:
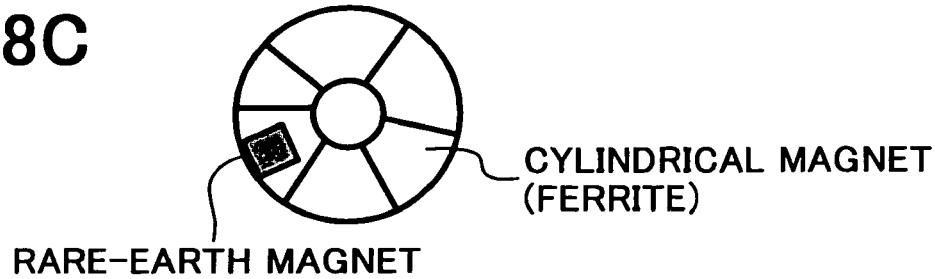
Figure 9:
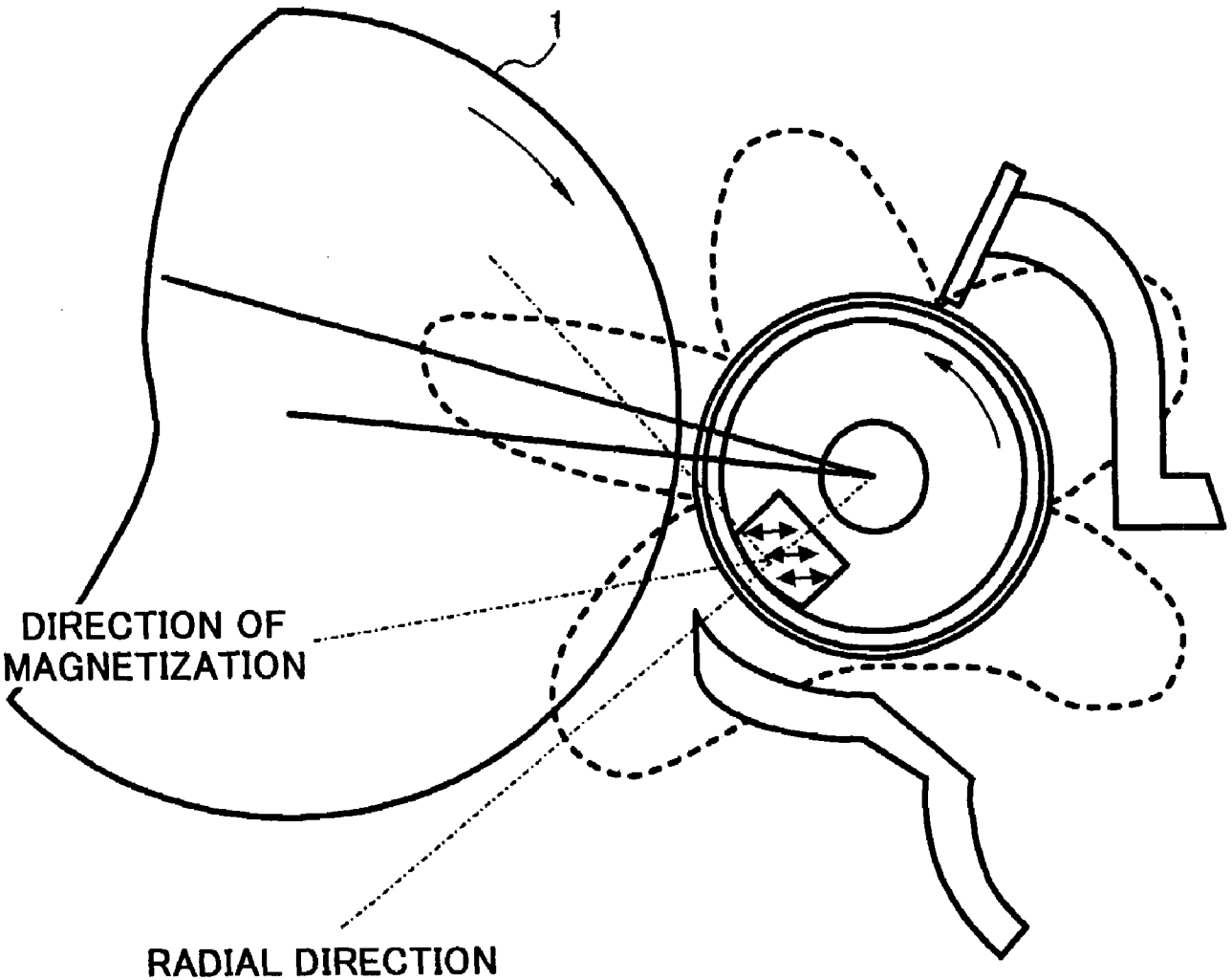
FIG. 9 shows a relation to hold when the direction of magnetization of a downstream pole is oriented to the upstream side relative to the radial direction.

FIGS. 8A through 8C each show a particular configuration of the developing roller 14. In FIG. 8A, a material containing rare earth metal is buried in part of a cylindrical magnet. In FIG. 8B, magnets in the form of blocks are arranged on a cylindrical magnet. In FIG. 8C, magnets in the form of sectorial pieces are arranged on a cylindrical magnet. While the magnets are usually oriented in the radial direction, the magnet constituting the downstream pole may be magnetized in the direction upstream of the radial direction, as shown in FIG. 9 specifically. It is most efficient to locate the direction of magnetization of the above particular magnet between the radial direction and the closest point in increasing the magnetic force.

As for a rare-earth magnet material, it is generally desirable from the process and cost standpoint to use a high molecular compound containing Nd—Fe—B or Sm—Fe—N magnet powder mixed or kneaded therewith, i.e., a so-called plastic magnet. In this case, the maximum energy product Bhmax should preferably be 8 MGOe or above. High magnetic characteristics are achievable if a magnetically anisotropic material is molded under a magnetic field.

If desired, the rare-earth magnet may be replaced with a plastic magnet or a rubber magnet formed by mixing a high molecular compound in magnetic powder. For the magnetic powder, use may be made of Sr ferrite or Ba ferrite. The high molecular compound may be implemented by any one of 6PA, 12PA or similar PA material, EEA (ethylene-ethyl copolymer), EVA (ethylene-vinyl copolymer) or similar ethylene compound, CPE (chlorinated polyethylene) or similar chlorine compound, and NBR or similar rubber. Most preferably, the rare-earth magnet should be a mixture of anisotropic Nd—Fe—B magnetic powder and a high molecular compound.

Examples of the present invention and a comparative example will be described hereinafter.

EXAMPLE 1

Figure 10A:
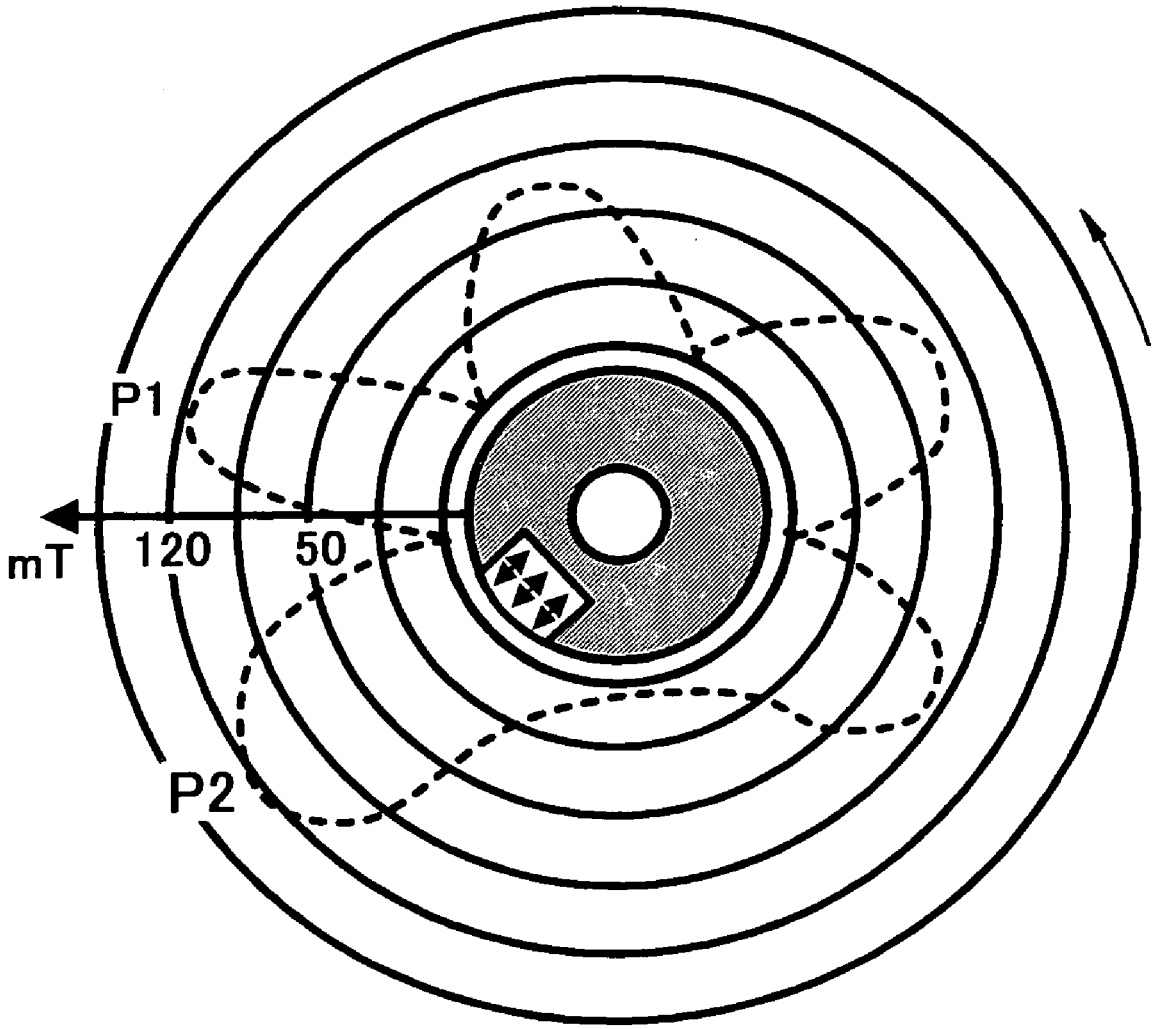
FIG. 10A shows a radial flux density distribution particular to Example 1 of the present invention.
Figure 10B:
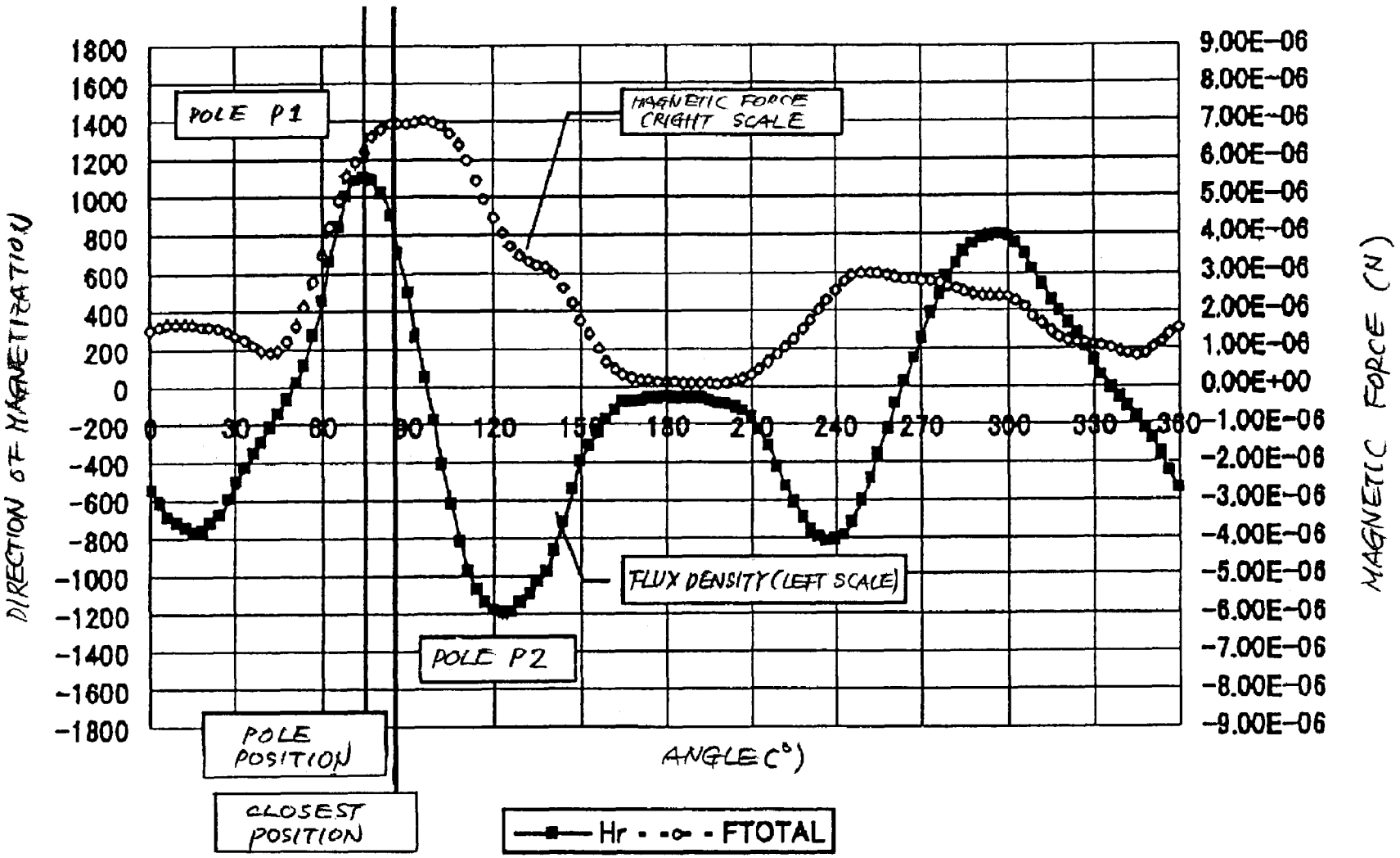
FIG. 10B shows a magnetic force distribution particular to Example 1.

In the developing device 4 with the configuration shown in FIG. 3, the developing roller 14 had an outside diameter of 18 mm and included a pole P1 for development shifted from the closest position 32 by 10° to the upstream side. A rare-earth magnet block produced by mixing anisotropic Nd—Fe—B and a high molecular compound was buried in a pole P2 just downstream of the pole P1. In this condition, as shown in FIG. 10A, magnetic forces of 100 mT and 120 mT were attained at the poles P1 and P2, respectively, as measured on the surface of the sleeve. FIG. 10B shows a magnetic force distribution derived from the above configuration; the half-value width and attenuation ratio of the pole P1 were 29° and 32.3%, respectively.

Japanese Patent Laid-Open Publication No. 2002-62737, for example, teaches that to obviate the blur of the trailing edge of an image and other defects, a main pole for development should preferably have a half-value width of 25° or below and an attenuation ratio of 40% or above. Image quality can be improved to a certain degree even when such factors do not lie in the above ranges, depending on the outside diameter of the developing roller or that of the drum. This is because the nip width over which the developer contacts the drum is dependent not only on the half-value width and attenuation ratio of the main pole but also on the outside diameters of the developing roller an drum (see FIG. 13). As FIG. 13 indicates, when the drum diameter is about 30 mm, image quality is improved when the half-value width corresponds to a pole width of about 4 mm; as the drum diameter increase, the effective half-value width decreases. On the other hand, for a magnet having given energy, the magnetic flux implements a strong magnetic force more easily as the half-value width increases, so that the half-value width should preferably be between 25° and 35° for obviating carrier deposition and attaining high image quality.

In the developing device described above, images were formed by use of a carrier with a mean grain size of 55 μm and a carrier with a mean grain size of 35 μm. FIG. 14 lists the results of estimation. As shown, images were improved with respect to both of image quality and carrier deposition.

EXAMPLE 2

Figure 11A:
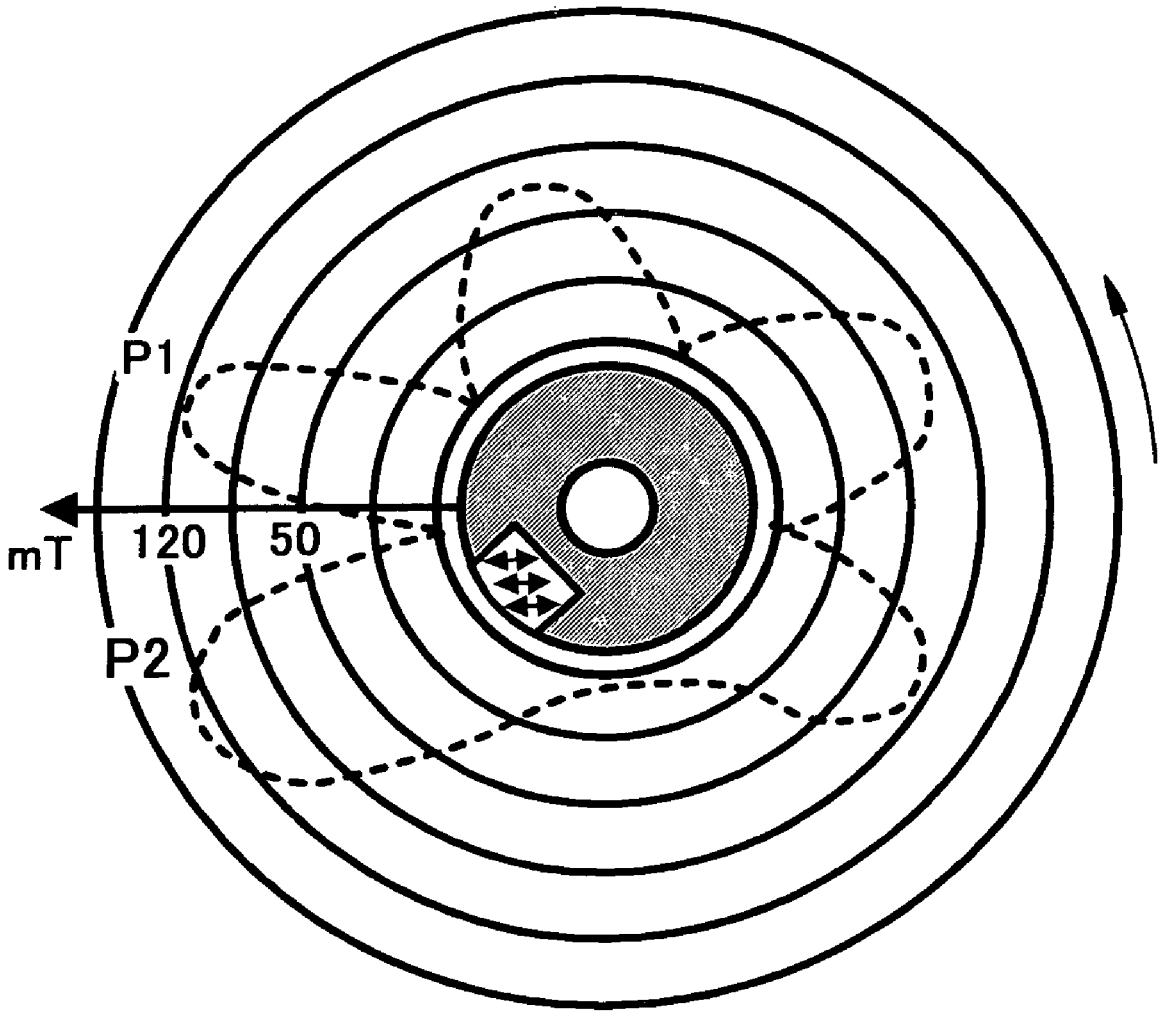
FIG. 11A shows a radial flux density distribution particular to Example 2 of the present invention.
Figure 11B:
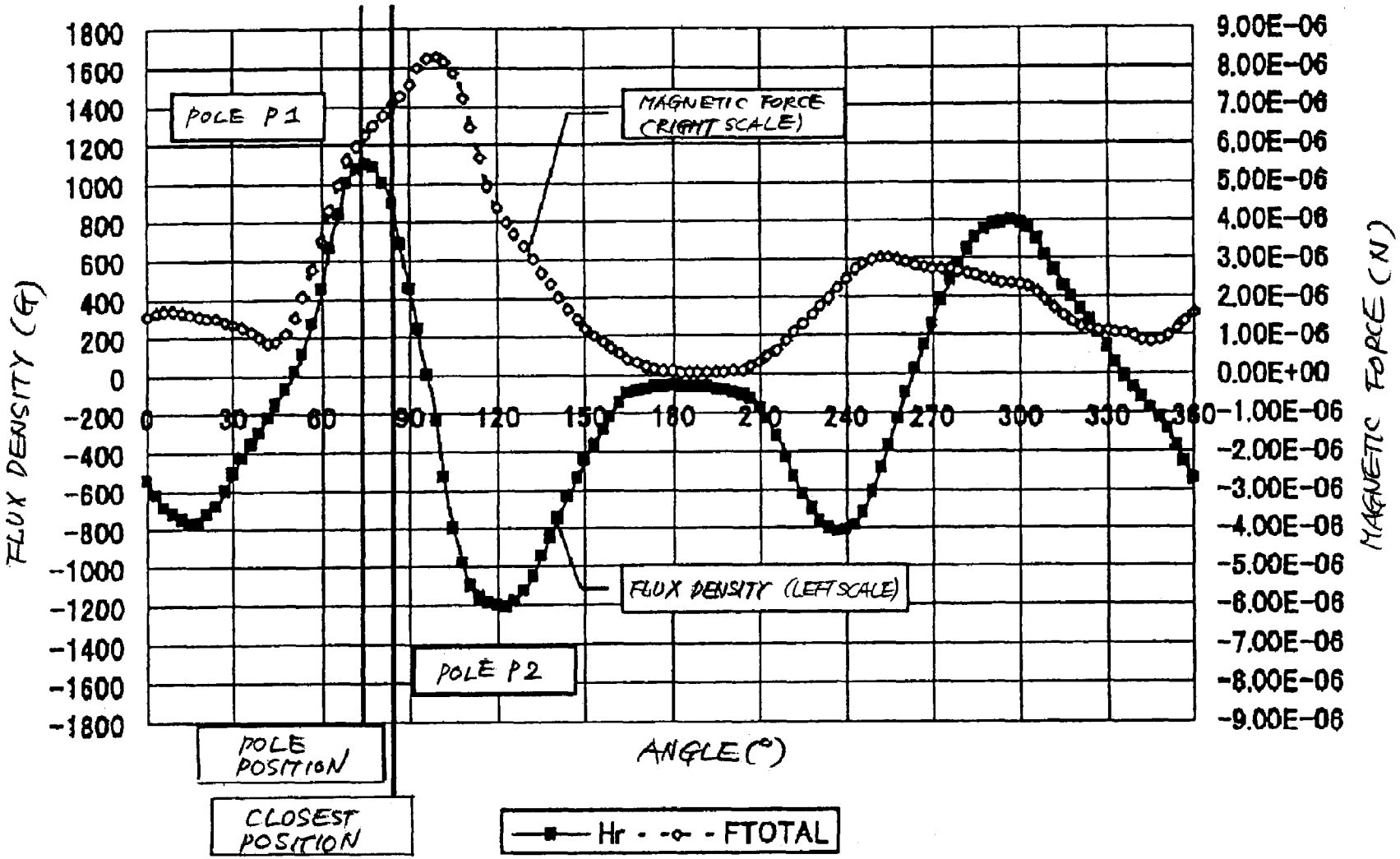
FIG. 11B shows a magnetic force distribution particular to Example 2.

As shown in FIG. 11A, Example 2 was identical with Example 1 except that the direction of magnetization of the magnet block was shifted from the radial direction toward the pole for development (upstream side). As shown FIG. 11B, Example 2 achieved a magnetic force even higher than that of Example 1. The pole P1 had a half-value width of 28° and an attenuation ratio of 31.7%. FIG. 15 shows the results of experiments conducted to determine image quality by using the carriers whose mean grain sizes were 55 μm and 35 m.

COMPARATIVE EXAMPLE

Figure 12A:
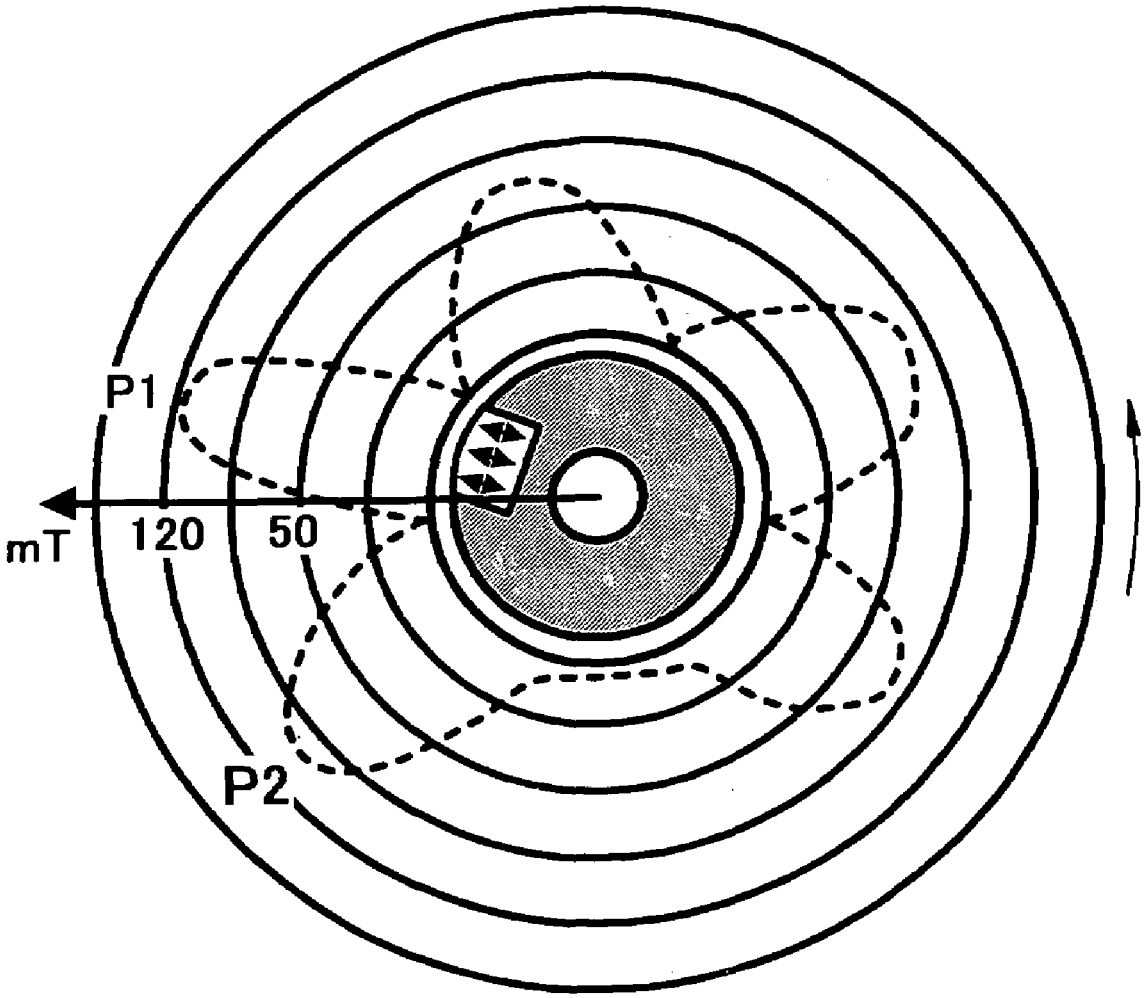
FIG. 12A shows a radial flux density distribution particular to Comparative Example.
Figure 12B:
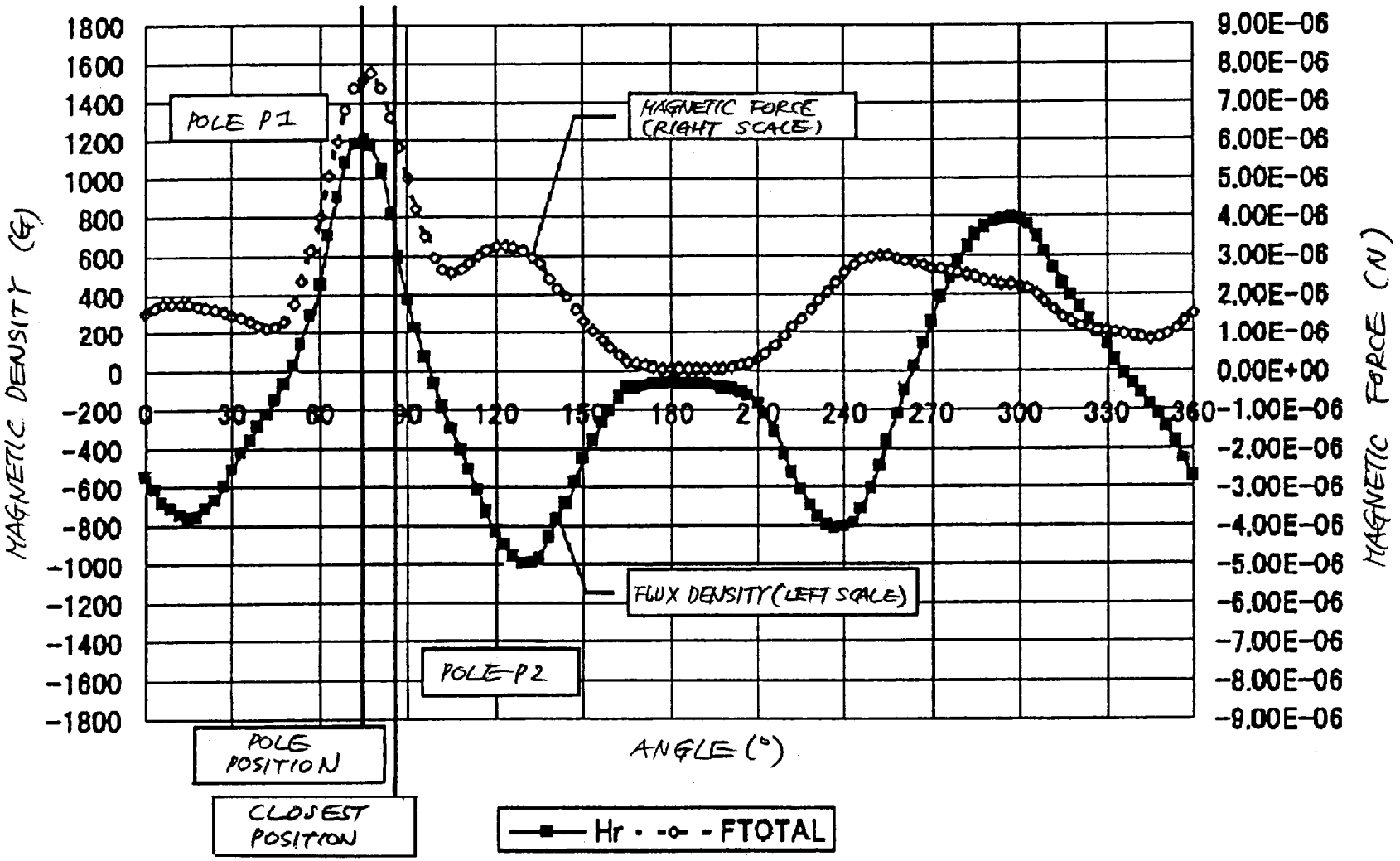
FIG. 12B shows a magnetic force distribution particular to Comparative Example.

As shown in FIG. 12A, a rare-earth magnet block was not buried in the pole P2, but buried in the pole P1. The poles P1 and P2 exerted magnetic forces of 120 mT and 80 mT, respectively. FIG. 12B shows the resulting magnetic force distribution. As shown in FIG. 16A, when image quality was examined by use of the carriers having grain sizes of 55 μm and 35 μm, image quality and carrier deposition were contrary to each other.

In summary, in accordance with the present invention, a magnetic pole for development is located upstream of the closest position of a developer carrier and an image carrier in the direction of rotation. A magnetic force, as measured on the surface of the developer carrier, increases from the position of the above pole toward a position where a magnet brush finally leaves the image carrier. It follows that a margin as to carrier deposition increases in a portion between the pole of development and the position where the magnet brush leaves the image carrier, realizing images free from defects.

A magnetic pole just downstream of the pole for development has a radial flux density higher than the flux density of the pole for development, so that the magnetic force is higher between the pole for development and the downstream pole than at the pole for development. By locating a magnet block containing a rare-earth element at the downstream block or locating a rare-earth magnet only at the downstream block, it is possible to increase the magnetic force between the pole for development and the downstream pole at low cost.

Further, when the magnet block containing a rare-earth element is implemented as a magnetically anisotropic Nd—Fe—B magnet, the magnetic force can be easily increased at the position where the magnet brush leaves the image carrier, increasing the margin as to carrier deposition at the upstream side. The margin can be further increased if the direction of magnetization of the magnet block containing a rare-earth element is oriented to the upstream side relative to the radial direction, particularly if the above direction of magnetization is positioned between the radial direction of the developer carrier and the closest position.

Moreover, when use is made of a carrier whose mean grain size is as small as 50 μm or less, a latent image formed on the image carrier can be faithfully developed with high quality while carrier deposition can be obviated.

Various modifications will become possible for those skilled in the art after receiving the teachings of the present disclosure without departing from the scope thereof.

What is claimed is:

1. A developing device for developing a latent image formed on an image carrier, said developing device comprising:

a rotatable, nonmagnetic developer carrier; and means for generating a magnetic field in a developing zone where said developer carrier faces the image carrier, said magnetic field causing a developer deposited on said developer carrier to rise in the form of a magnet brush, wherein a first magnetic pole for development is located upstream of a closest position where said developer carrier and the image carrier are closest to each other in a direction of rotation, a second magnetic pole is located just downstream of the first magnetic pole and a radial flux density of said second magnetic pole is higher than a radial flux density of said first magnetic pole, and a magnetic force, as measured on a surface of said developer carrier, continuously increases from a position of the first magnetic pole toward a position where the magnet brush finally leaves the image carrier.

2. The device as claimed in claim 1, wherein a magnetic carrier contained in the developer has a mean grain size of 50 μm or below.

3. The device as claimed in claim 1, wherein the first magnetic pole for development has a half-value width of 30° or below.

4. The device as claimed in claim 3, wherein a magnetic carrier contained in the developer has a mean grain size of 50 μm or below.

5. The device as claimed in claim 1, wherein the first magnetic pole for development is shifted from the closest position by 10° or above to an upstream side.

6. The device as claimed in claim 5, wherein the position where the magnet brush finally leaves the image carrier is located at or upstream of the closest position.

7. The device as claimed in claim 6, wherein a magnetic carrier contained in the developer has a mean grain size of 50 μm or below.

8. The device as claimed in claim 1, wherein a magnet block containing a rare-earth element is located at the second magnetic pole just downstream of the first magnetic pole for development.

9. The device as claimed in claim 8, wherein the magnet block containing a rare-earth element comprises a magnetically anisotropic Nd—Fe—B magnet.

10. The device as claimed in claim 9, wherein a magnetic carrier contained in the developer has a mean grain size of 50 μm or below.

11. The device as claimed in claim 8, wherein a direction of magnetization of the magnet block containing a rare-earth element is oriented to an upstream side relative to a radial direction of said developer carrier.

12. The device as claimed in claim 11, wherein the direction of magnetization is oriented to a position between the radial direction of said developer carrier and the closest position.

13. The device as claimed in claim 12, wherein a magnetic carrier contained in the developer has a mean grain size of 50 μm or below.

14. The device as claimed in claim 1, wherein a rare-earth magnet is positioned only at the second magnetic pole just downstream of the first magnetic pole for development.

15. The device as claimed in claim 14, wherein the rare-earth magnet block comprises a magnetically anisotropic Nd—Fe—B magnet.

16. The device as claimed in claim 15, wherein a magnetic carrier contained in the developer has a mean grain size of 50 μm or below.

17. The device as claimed in claim 15, wherein a direction of magnetization of the magnet block containing a rare-earth element is oriented to an upstream side relative to a radial direction of said developer carrier.

18. The device as claimed in claim 17, wherein the direction of magnetization is oriented to a position between the radial direction of said developer carrier and the closest position.

19. The device as claimed in claim 18, wherein a magnetic carrier contained in the developer has a mean grain size of 50 μm or below.

20. A process cartridge comprising a developing device for developing a latent image formed on an image carrier, said developing device comprising:

a rotatable, nonmagnetic developer carrier; and means for generating a magnetic field in a developing zone where said developer carrier faces the image carrier, said magnetic field causing a developer deposited on said developer carrier to rise in the form of a magnet brush, wherein a first magnetic pole for development is located upstream of a closest position where said developer carrier and the image carrier are closest to each other in a direction of rotation, a second magnetic pole is located just downstream of the first magnetic pole and a radial flux density of said second magnetic pole is higher than a radial flux density of said first magnetic pole, and a magnetic force, as measured on a surface of said developer carrier, continuously increases from a position of the first magnetic pole toward a position where the magnet brush finally leaves the image carrier.

21. The cartridge as claimed in claim 20, wherein a magnetic carrier contained in the developer has a mean grain size of 50 μm or below.

22. The cartridge as claimed in claim 20, wherein the first magnetic pole for development has a half-value width of 30° or below.

23. The cartridge as claimed in claim 22, wherein a magnetic carrier contained in the developer has a mean grain size of 50 μm or below.

24. The cartridge as claimed in claim 20, wherein the first magnetic pole for development is shifted from the closest position by 10° or above to an upstream side.

25. The cartridge as claimed in claim 24, wherein the position where the magnet brush finally leaves the image carrier is located at or upstream of the closest position.

26. The cartridge as claimed in claim 25, wherein a magnetic carrier contained in the developer has a mean grain size of 50 μm or below.

27. The cartridge as claimed in claim 20, wherein a magnet block containing a rare-earth element is located at the second magnetic pole just downstream of the first magnetic pole for development.

28. The cartridge as claimed in claim 27, wherein the magnet block containing a rare-earth element comprises a magnetically anisotropic Nd—Fe—B magnet.

29. The cartridge as claimed in claim 28, wherein a magnetic carrier contained in the developer has a mean grain size of 50 μm or below.

30. The cartridge as claimed in claim 27, wherein a direction of magnetization of the magnet block containing a rare-earth element is oriented to an upstream side relative to a radial direction of said developer carrier.

31. The cartridge as claimed in claim 30, wherein the direction of magnetization is oriented to a position between the radial direction of said developer carrier and the closest position.

32. The cartridge as claimed in claim 31, wherein a magnetic carrier contained in the developer has a mean grain size of 50 μm or below.

33. The cartridge as claimed in claim 20, wherein a rare-earth magnet is positioned only at the second magnetic pole just downstream of the first magnetic pole for development.

34. The cartridge as claimed in claim 33, wherein the rare-earth magnet block comprises a magnetically anisotropic Nd—Fe—B magnet.

35. The cartridge as claimed in claim 34, wherein a magnetic carrier contained in the developer has a mean grain size of 50 μm or below.

36. The cartridge as claimed in claim 33, wherein a direction of magnetization of the magnet block containing a rare-earth element is oriented to an upstream side relative to a radial direction of said developer carrier.

37. The cartridge as claimed in claim 36, wherein the direction of magnetization is oriented to a position between the radial direction of said developer carrier and the closest position.

38. The cartridge as claimed in claim 37, wherein a magnetic carrier contained in the developer has a mean grain size of 50 μm or below.

39. An image forming apparatus comprising a developing device for developing a latent image formed on an image carrier, said developing device comprising:

a rotatable, nonmagnetic developer carrier; and means for generating a magnetic field in a developing zone where said developer carrier faces the image carrier, said magnetic field causing a developer deposited on said developer carrier to rise in the form of a magnet brush, wherein a first magnetic pole for development is located upstream of a closest position where said developer carrier and the image carrier are closest to each other in a direction of rotation, a second magnetic pole is located just downstream of the first magnetic pole and a radial flux density of said second magnetic pole is higher than a radial flux density of said first magnetic pole, and a magnetic force, as measured on a surface of said developer carrier, continuously increases from a position of the first magnetic pole toward a position where the magnet brush finally leaves the image carrier.

40. The apparatus as claimed in claim 39, wherein a magnetic carrier contained in the developer has a mean grain size of 50 μm or below.

41. The apparatus as claimed in claim 39, wherein the first magnetic pole for development has a half-value width of 30° or below.

42. The apparatus as claimed in claim 41, wherein a magnetic carrier contained in the developer has a mean grain size of 50 μm or below.

43. The apparatus as claimed in claim 39, wherein the first magnetic pole for development is shifted from the closest position by 10° or above to an upstream side.

44. The apparatus as claimed in claim 43, wherein the position where the magnet brush finally leaves the image carrier is located at or upstream of the closest position.

45. The apparatus as claimed in claim 44, wherein a magnetic carrier contained in the developer has a mean grain size of 50 μm or below.

46. The apparatus as claimed in claim 39, wherein a magnet block containing a rare-earth element is located at the second magnetic pole just downstream of the first magnetic pole for development.

47. The apparatus as claimed in claim 46, wherein the magnet block containing a rare-earth element comprises a magnetically anisotropic Nd—Fe—B magnet.

48. The apparatus as claimed in claim 47, wherein a magnetic carrier contained in the developer has a mean grain size of 50 μm or below.

49. The apparatus as claimed in claim 39, wherein a direction of magnetization of the magnet block containing a rare-earth element is oriented to an upstream side relative to a radial direction of said developer carrier.

50. The apparatus as claimed in claim 49, wherein the direction of magnetization is oriented to a position between the radial direction of said developer carrier and the closest position.

51. The apparatus as claimed in claim 50, wherein a magnetic carrier contained in the developer has a mean grain size of 50 μm or below.

52. The apparatus as claimed in claim 39, wherein a rare-earth magnet is positioned only at the second magnetic pole just downstream of the first magnetic pole for development.

53. The apparatus as claimed in claim 52, wherein the rare-earth magnet block comprises a magnetically anisotropic Nd—Fe—B magnet.

54. The apparatus as claimed in claim 53, wherein a magnetic carrier contained in the developer has a mean grain size of 50 μm or below.

55. The apparatus as claimed in claim 39, wherein a direction of magnetization of the magnet block containing a rare-earth element is oriented to an upstream side relative to a radial direction of said developer carrier.

56. The apparatus as claimed in claim 5, wherein the direction of magnetization is oriented to a position between the radial direction of said developer carrier and the closest position.

57. The apparatus as claimed in claim 56, wherein a magnetic carrier contained in the developer has a mean grain size of 50 μm or below.

58. A developing device for developing a latent image formed on an image carrier, said developing device comprising:

a rotatable, nonmagnetic developer carrier; and means for generating a magnetic field in a developing zone where said developer carrier faces the image carrier, said magnetic field causing a developer deposited on said developer carrier to rise in the form of a magnet brush, wherein a first magnetic pole for development is located upstream of a closest position where said developer carrier and the image carrier are closest to each other in a direction of rotation, a second stationary magnetic pole is fixedly located just downstream of the first magnetic pole, and a magnetic force, as measured on a surface of said developer carrier, continuously increases from a position of the first magnetic pole toward a position where the magnet brush finally leaves the image carrier.

59. A process cartridge comprising a developing device for developing a latent image formed on an image carrier, said developing device comprising:

a rotatable, nonmagnetic developer carrier; and means for generating a magnetic field in a developing zone where said developer carrier faces the image carrier, said magnetic field causing a developer deposited on said developer carrier to rise in the form of a magnet brush, wherein a first magnetic pole for development is located upstream of a closest position where said developer carrier and the image carrier are closest to each other in a direction of rotation, a second stationary magnetic pole is fixedly located just downstream of the first magnetic pole, and a magnetic force, as measured on a surface of said developer carrier, continuously increases from a position of the first magnetic pole toward a position where the magnet brush finally leaves the image carrier.

60. An image forming apparatus comprising a developing device for developing a latent image formed on an image carrier, said developing device comprising:

a rotatable, nonmagnetic developer carrier; and means for generating a magnetic field in a developing zone where said developer carrier faces the image carrier, said magnetic field causing a developer deposited on said developer carrier to rise in the form of a magnet brush, wherein a first magnetic pole for development is located upstream of a closest position where said developer carrier and the image carrier are closest to each other in a direction of rotation, a second stationary magnetic pole is fixedly located just downstream of the first magnetic pole, and a magnetic force, as measured on a surface of said developer carrier, continuously increases from a position of the first magnetic pole toward a position where the magnet brush finally leaves the image carrier.

* * * * *